US006631724B2

(12) United States Patent
Mugge et al.

(10) Patent No.: US 6,631,724 B2
(45) Date of Patent: Oct. 14, 2003

(54) DEVICE FOR APPLYING AN ADDITIVE TO HAIR

(75) Inventors: Jan Mugge, Drachten (NL); Lippe Van Der Brug, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 77 days.

(21) Appl. No.: 09/952,195

(22) Filed: Sep. 14, 2001

(65) Prior Publication Data

US 2002/0053351 A1 May 9, 2002

(30) Foreign Application Priority Data

Sep. 15, 2000 (SG) ..... 200005250
Oct. 26, 2000 (EP) ..... 00203715

(51) Int. Cl.[7] ..... A45D 24/22
(52) U.S. Cl. ..... 132/112; 132/271
(58) Field of Search ..... 132/207, 210, 132/211, 112, 116, 232, 269, 271, 272, 313; 219/225; 222/145.2, 153.09, 191; 401/2, 140, 268

(56) References Cited

U.S. PATENT DOCUMENTS 2,278,811 A * 4/1942 Wallenius ..... 132/116
2,565,889 A * 8/1951 Schroer ..... 132/112
2,737,190 A * 3/1956 Magnusson et al. ..... 132/114
3,520,311 A * 7/1970 Iesersek et al. ..... 132/111
3,610,259 A * 10/1971 Brown ..... 132/232
3,702,616 A * 11/1972 Mercer ..... 132/272
4,029,110 A * 6/1977 Hyland ..... 132/232
4,090,522 A * 5/1978 Donley et al. ..... 132/112
4,557,619 A * 12/1985 DeVincentis ..... 401/190
5,046,516 A * 9/1991 Barradas ..... 132/232
5,241,974 A * 9/1993 Tsai ..... 132/272
5,494,058 A * 2/1996 Chan ..... 132/228
6,024,052 A * 2/2000 Efaw ..... 119/625

FOREIGN PATENT DOCUMENTS

EP 0523460 B1 1/1993

* cited by examiner

*Primary Examiner*—Eduardo C. Robert
*Assistant Examiner*—David Comstock
(74) *Attorney, Agent, or Firm*—Ernestine C. Bartlett

(57) ABSTRACT

A device (1) for applying an additive to hair, comprising a longitudinally extending base part (2) for making contact with the hair during operation, which base part (2) comprises a distribution system (3) for additive. The distribution system (3) has an inlet (4) which is connected to an additive dispenser (5), and which distribution system has outlets (6) for applying the additive to the hair during operation. The distribution system (3) comprises a carrier element (10) with distribution channels (7) which is covered by a covering element (11), while said carrier element (10) and covering element (11) are detachably connected to each other. Detaching of the carrier element (10) from the covering element (11) uncovers the carrier element (10) with the distribution channels (7) so that the distribution system (3) becomes accessible for cleaning purposes.

6 Claims, 2 Drawing Sheets

DEVICE FOR APPLYING AN ADDITIVE TO HAIR

Figure 1:
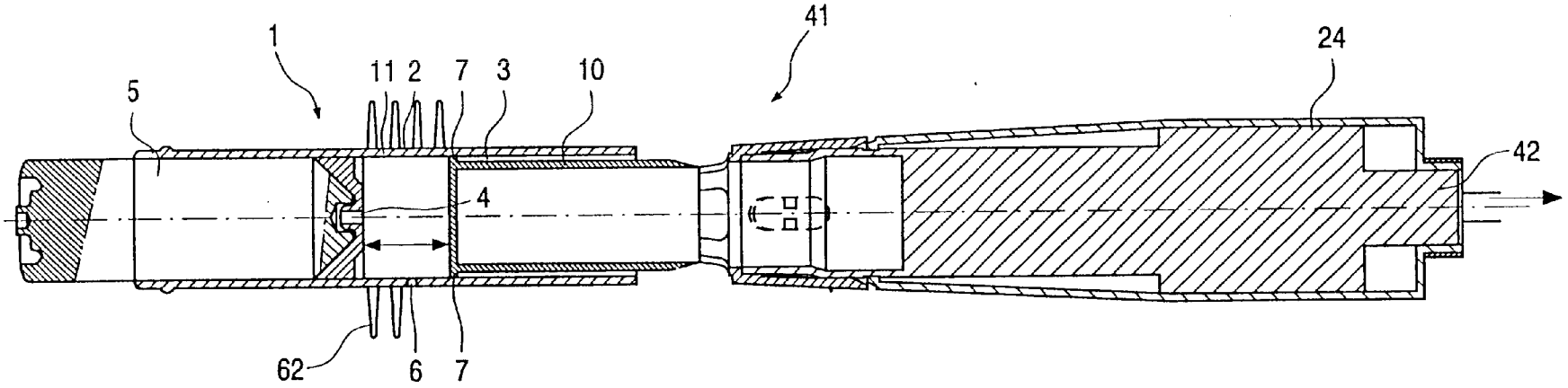

The invention relates to a device for applying an additive to hair, comprising a longitudinally extending base part for making contact with the hair during operation, which base part comprises a distribution system for additive, which distribution system has an inlet which is connected to an additive dispenser, and which distribution system has outlets for applying the additive to the hair during operation.

The invention further relates to an electric hairstyler comprising power supply means and a handle, and comprising a device for applying an additive to hair, which device comprises a longitudinally extending base part for making contact with the hair during operation, which base part comprises a distribution system for additive, which distribution system has an inlet which is connected to an additive dispenser, and which has outlets for applying the additive to the hair during operation.

A device for applying an additive to hair of the type defined in the opening paragraph is known from EP 0 523 460 B1. The base part of this known device is formed by a comb body with comb teeth. The comb body and the comb teeth are hollow and thus form the distribution system for the distribution of additive, which in this known device is a foam for styling of the hair. The inlet is a discharging tube in the hollow comb body, which is connected to the additive dispenser comprising a jet operating portion and a container. The outlets of the distribution system through which the foam is applied to the hair during operation are formed by apertures in the ends of the hollow comb teeth. By activating a button during operation, foam is jetted from the dispenser through the foam discharging tube and the hollow comb body, through the hollow comb teeth to the apertures in said comb teeth, and thus directed to the hair. A disadvantage of the known device is that additive remaining in the distribution system after operation cannot be removed from the distribution system in a convenient way. This is problematic since remaining additive obstructs the distribution system and thus hampers a proper operation of the device.

It is an object of the invention to provide a device for applying an additive to hair of the type defined in the opening paragraph that is easy to clean.

To achieve this object, a device for applying an additive to hair according to the invention is characterized in that the distribution system comprises a carrier element with distribution channels, which element is covered by a covering element, while said carrier element and covering element are detachably connected to each other. The distribution system can be made easily accessible for cleaning purposes through detaching of the carrier element from the covering element. Consequently, the distribution system can be kept clean in an easy manner and a good hairstyling performance of the device is safeguarded. The distribution system is furthermore composed of only two components, which components can be manufactured efficiently in mass production and are easy to assemble. The distribution system can thus be realized in a comparatively simple and cost-effective way. Next to that, the covering element performs a double function. On the one hand its inner circumferential area covers the distribution system, and on the other hand its outer circumferential area can accommodate additional hairstyling elements such as brush hairs or pins.

According to the invention, an electric hairstyler of the kind mentioned in the opening paragraphs is characterized in that the device for applying an additive is a device according to the invention.

In an electric hairstyler according to the invention, comprising a carrier element and a covering element detachably connected to each other, it is advantageous when the carrier element and the covering element are connected to the handle during operation, and are detachable from the handle only in attachment to each other. A potentially hazardous situation arises if one of the respective elements should stay attached to the handle after the other part has been detached. A user, wishing to clean both elements after use of the hairstyler with additive, can clean the one loose part safely with, for example, water. The handle with the power supply means, to which the other part is still attached, should not come into contact with liquids because it could accidentally still be plugged in. If the carrier element and the covering element can only be detached from the handle when they are attached to each other, the elements can both be cleaned individually only after detaching both of them have been detached from the handle with electrical components. This benefits the safety of use of the device.

It is advantageous when the carrier element comprises a slot and the covering element comprises a flexible tongue, which tongue fits into the slot when the carrier element and the covering element are attached to each other, the handle comprising a blocking element which blocks the tongue in the slot when the carrier element is attached to the handle. It is not until both the carrier element and the covering element together have been detached from the handle that the tongue of the covering element is no longer blocked in the slot in the carrier element by the blocking element and can be disengaged from the carrier element.

Figure 2A:
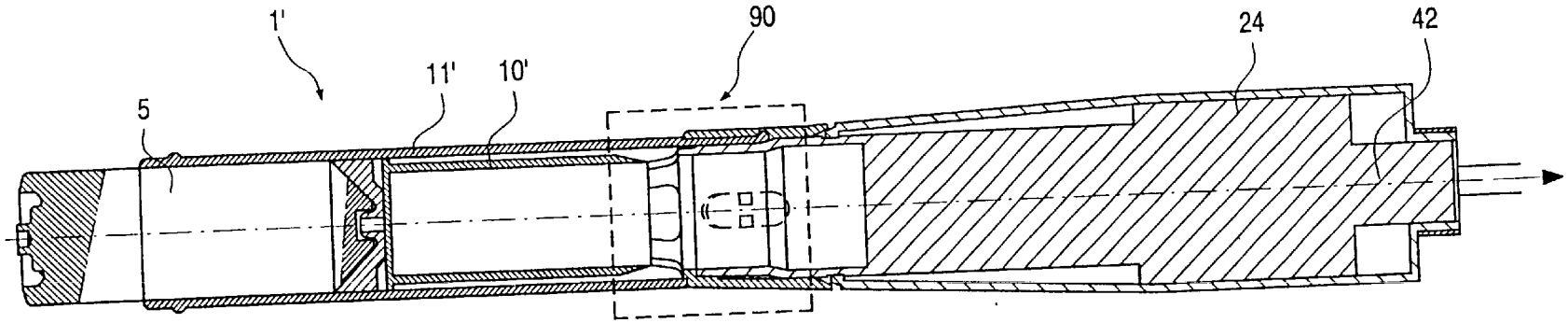
Figure 2B:
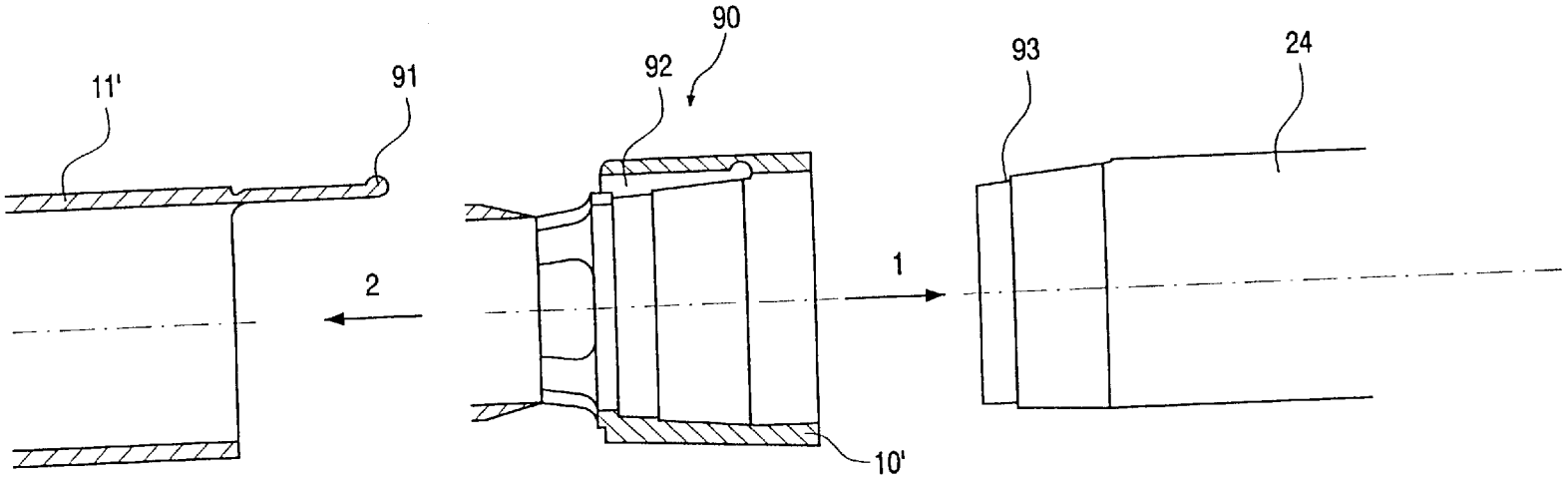

The invention will be described in more detail below with reference to the drawings, in which FIG. 1 is a diagrammatic view of an electric hairstyler according to the invention comprising a first embodiment of a device for applying an additive to hair according to the invention, FIG. 2*a* is a diagrammatic view of a second embodiment of a device for applying an additive according to the invention having a detachable connection between a carrier element and a covering element, the carrier element and the covering element being coupled to one another and to the handle 24 of the electric hairstyler 41 according to the invention, and FIG. 2*b* shows the detachable connection between the carrier element and the covering element of FIG. 2*a,* the carrier element and the covering element being in an uncoupled condition.

FIG. 1 shows a first embodiment of a device 1 for applying an additive to hair according to the invention, provided in an electric hairstyler 41 according to the invention. The device 1 comprises a longitudinally extending base part 2 for making contact with the hair during operation, the base part 2 comprising a distribution system 3 for additive. In this embodiment, the base part 2 is provided with brush pins 62 on the majority of its outer circumferential surface. However, variations in elements and areas on the base part where these elements are provided are possible. Brush pins may also be provided on, for example, only half of the outer circumferential surface of the base part 2, or brush hairs may be provided instead of pins. The distribution system 3 has an inlet 4 which is connected to an additive dispenser 5. The additive dispenser 5 may be of a type which is known per se, depending on the additive to be used. The inlet 4 issues into a carrier element 10, formed by a hollow cylindrical body, which is covered by a covering element 11 formed by a second hollow cylindrical body with a diameter that is larger than the diameter of the carrier element 10. The carrier element 10 is connected to the handle 24 during operation. Distribution channels 7 in this embodiment are formed by a space between the carrier element 10 and the covering element 11, which space is a result of the difference in diameters of the elements, and which space is provided with partitions which are not further shown in the Figure. The covering element 11 has outlets 6 for applying the additive to the hair during operation, formed by openings in the wall of the cylindrical body of the covering element 11 which are in communication with openings in the wall of the cylindrical body of the carrier element 10. Said covering element 11 is detachable from the carrier element 10 through sliding of the two cylindrical elements from one another in a direction along their longitudinal axis. The covering element 11 can thus be detached from the carrier element 10 after use of the device, and the parts can be easily cleaned to remove any residual additive. This benefits a proper flow of additive through the distribution system 3 during a next use of the device 1. The electric hairstyler 41 further comprises power supply means 42. The power supply means 42 are of a type which is known per se and are shown diagrammatically here.

FIG. 2*a* is a diagrammatic view of a second embodiment of a device 1' for applying an additive according to the invention having a detachable connection 90 between a carrier element 10' and a covering element 11', the carrier element and the covering element being coupled to one another and to the handle 24 of the electric hairstyler 41 according to the invention. The parts of the carrier element 10' and the covering element 11' that are related to the distribution of additive are shown diagrammatically only.

FIG. 2*b* shows the detachable connection 90 between the carrier element 10' and the covering element 11' of FIG. 2*a,* the carrier element and the covering element being in an uncoupled condition. The carrier element 10' comprises a slot 92 and the covering element 11' comprises a flexible tongue 91, which tongue 91 fits into the slot 92 when the carrier element 10' and the covering element 11' are attached to each other. The handle 24 comprises a blocking element 93, formed by a flange which is a part of the handle, which blocks the tongue 91 in the slot 92 when the carrier element 10' is attached to the handle. When the handle 24 with the blocking element 93 has been separated from the assembly of the carrier element 10' with the covering element 11', as indicated with arrow 1, the blocking element 93 does not block the tongue 91 of the covering element 11' in the slot 92 in the carrier element 10' anymore. Then the tongue 91 is released from the slot 92, as indicated with arrow 2, and the covering element 11' and the carrier element 10' are detached from each other. If after use one of the elements should stay attached to the handle, which accommodates the electrical components, the element connected to the handle could be exposed to liquid during cleaning with the handle still being plugged in. This would lead to a hazardous situation for the user. Since in this preferred embodiment these elements are detachable from one another only after detachment of both elements from the handle, the two elements can be cleaned separately only after being detached from the handle, and thus a safe handling of the device is safeguarded also after operation.

It is noted that the invention is not limited to the embodiment as described above. Instead of the detachable connection between the carrier element and the covering element being formed by a tongue fitting in a slot and blocked therein by a blocking element, this connection, for example, could also comprise any other type of connection such as, for example, a screw or a snap connection.

It is further noted that the device 1 for applying an additive to hair according to the invention provided with the additive dispenser 5 as described above can be used independently or in combination with an electric hairstyler. If the carrier element 10 and the covering element 11 are provided in an electric hairstyler, the carrier element and the covering element are connected to the handle during operation. It is advantageous for the safety of use if these parts are detachable from the handle only in attachment to each other.

It is observed that the device for applying an additive to hair according to the invention is especially advantageous, because additives like foam, hair lotion, hair tonic, hair conditioner or hair dyes tend to remain in the distribution system after use owing to their composition, which makes easy cleaning of the device essential.

What is claimed is:

1. A device (1) for applying an additive to hair, comprising a longitudinally extending base part (2) for making contact with the hair during operation, said base part (2) comprising a distribution system (3) for additive;

said distribution system (3) having an inlet (4) which is connected to an additive dispenser (5) and outlets (6) for applying the additive to the hair during operation;

said distribution system (3) comprising a carrier element (10) covered by a covering element (11) during operation; and during operation the carrier element (10) and the covering element (11) are attached to each other, and are connected to the handle (24);

characterized in that the carrier element (10) and the covering element (11) are detachable from the handle (24) only in attachment to each other.

2. The device claimed in claim 1, characterized in that the carrier element (10') comprises a slot (92) and the covering element (11') comprises a flexible tongue (91), said tongue (91) fits into the slot (92) when the carrier element (10') and the covering element (11') are attached to each other, and the handle (24) comprises a blocking element (93) which blocks the tongue (91) in the slot (92) when the carrier element (10') is attached to the handle.

3. An electric hairstyler comprising:

means (62) for controlling the style of hair;

power supply means (42) for operating said means for controlling;

a handle (24); and a device (1) for applying an additive to hair;

said device comprising a longitudinally extending base part (2) for making contact with the hair during operation, said base part (2) comprising a distribution system (3) for additive;

said distribution system (3) having an inlet (4)which is connected to an additive dispenser (5) and outlets (6) for applying the additive to the hair during operation;

said distribution system (3) comprising a carrier element (10) covered by a covering element (11) during operation; and during operation the carrier element (10) and the covering element (11) being attached to each other, and being connected to the handle (24);

characterized in that the carrier element (10) and the covering element (11) are detachable from the handle (24) only in attachment to each other.

4. The electric hairstyler claimed in claim 3, characterized in that the carrier element (10') comprises a slot (92) and the covering element (11') comprises a flexible tongue (91), said tongue (91) fits into the slot (92) when the carrier element (10') and the covering element (11') are attached to each other, and the handle (24) comprises a blocking element (93) which blocks the tongue (91) in the slot (92) when the carrier element (10') is attached to the handle.

5. The electric hairstyler claimed in claim 3, characterized in that said means for controlling comprises a brush (62).

6. The electric hairstyler claimed in claim 3, characterized in that said means for controlling comprises pins (62).

* * * * *